United States Patent [19]

Weingerl et al.

[11] 4,272,305

[45] Jun. 9, 1981

[54] FERRITIC-AUSTENTITIC CHROMIUM-NICKEL STEEL AND METHOD OF MAKING A STEEL BODY

[75] Inventors: Hermann Weingerl; Manfred Koren, both of Kapfenberg, Austria

[73] Assignee: Vereinigte Edelstahl-Werke Aktiengesellschaft (VEW), Vienna, Austria

[21] Appl. No.: 28,815

[22] Filed: Apr. 10, 1979

[30] Foreign Application Priority Data

Apr. 10, 1978 [DE] Fed. Rep. of Germany ..... 2815439

[51] Int. Cl.[3] ..... C22C 38/58; C21D 1/02

[52] U.S. Cl. ..... 148/12 E; 75/128 A; 75/128 N; 148/38

[58] Field of Search ..... 148/37, 38, 136, 12 E; 75/128 A, 128 N, 128 W

[56] References Cited

U.S. PATENT DOCUMENTS

| | | | |
|---|---|---|---|
| 2,484,903 | 10/1949 | Payson | 75/128 W |
| 2,783,169 | 2/1957 | Morgan et al. | 148/136 |
| 3,362,813 | 1/1968 | Ziolkowski | 75/128 A |
| 3,567,434 | 3/1971 | Richardson et al. | 75/125 |
| 3,926,685 | 12/1975 | Gueussier et al. | 148/37 |
| 4,032,367 | 6/1977 | Richardson et al. | 75/128 A |

FOREIGN PATENT DOCUMENTS

| | | | |
|---|---|---|---|
| 2457089 | 6/1975 | Fed. Rep. of Germany | 148/38 |

*Primary Examiner*—Peter K. Skiff
*Attorney, Agent, or Firm*—Karl F. Ross

[57] ABSTRACT

Steel bodies composed of ferritic-austenitic Cr-Ni steel with 30 to 70% austenite and consisting essentially of:

up to 0.1% by weight carbon,
up to 1.0% by weight silicon,
4.0% to 6.0% by weight manganese,
22.0% to 28.0% by weight chromium,
3.5% to 5.5% by weight nickel,
1.0% to 3.0% by weight molybdenum,
0.35% to 0.6% by weight nitrogen,
balance iron and unavoidable impurities, are subjected to forging and after even second degree deforming, possess a notch impact strength (tenacity) according to the ISO-V test of more than 35 Joule and a minimum yield point of 600 N/mm$^2$.

7 Claims, No Drawings

FERRITIC-AUSTENTITIC CHROMIUM-NICKEL STEEL AND METHOD OF MAKING A STEEL BODY

FIELD OF THE INVENTION

The present invention relates to a method of making improved forged bodies and, more particularly, to a method of fabricating forgings from a ferritic-austenitic chromium-nickel steel with little tendency to crack during forging, excellent mechanical properties and high resistance to corrosion.

BACKGROUND OF THE INVENTION

It is known to provide corrosion-resistant steels of the following composition:

up to 0.1% by weight carbon
up to 1.0% by weight silicon
up to 2.0% by weight manganese
up to 0.045% by weight phosphorus
up to 0.030% by weight sulfur
26.0% to 28.0% by weight chromium
1.3% to 2.0% by weight molybdenum
4.0% to 5.0% by weight nickel, balance iron and unavoidable impurities.

This austenitic-chromium-nickel steel has been found to have low corrosion rates and to be suitable, in many cases, for mechanical working. It has been referred to as No. 1.4460 steel and is analogous to Swedish steel of the Swedish industrial standard SIS 2324 which contains nitrogen in amounts up to 0.2% by weight.

Such steels, however, have not proved to be completely satisfactory in strength and in notch impact strength or tenacity for the fabrication of corrosion resistant forgings by impact forging processes. When attempts are made to raise the nitrogen content up to 0.4% by weight, the mechanical properties can be improved at least in part although the forging properties deteriorate, as evidenced by a strong tendency to the formation of cracks during forging.

OBJECTS OF THE INVENTION

It is the principal object of the present invention to provide an improved method of making high strength corrosion resistant articles whereby the disadvantages of earlier systems, including those using composition of the type described, are avoided.

Another object of the invention is to provide improved corrosion resistant shaped articles free from cracks or a tendency to corrode.

Yet another object of the invention is to provide a new use for ferritic-austenitic chromium-nickel steels and improved ferritic-austenitic chromium-nickel steel for these purposes.

It is also an object to provide a system wherein, upon the forging of a corrosion-resistant ferritic-austenitic chromium-nickel steel body at selected locations to carry out localized hot deformation, even in these zones a notch impact strength and tenacity of greater than 35 Joule (according to the ISO-V test) can be achieved.

DESCRIPTION OF THE INVENTION

These objects and others which will become apparent hereinafter are attained, in accordance with the present invention, through the use of an improved ferritic-austenitic chromium-nickel steel which contains 30% to 70% austenite and is of the following composition:

up to 0.1% by weight carbon,
up to 1.0% by weight silicon,
4.0% to 6.0% by weight manganese,
22.0% to 28.0% by weight chromium,
3.5% to 5.5% by weight nickel,
1.0% to 3.0% by weight molybdenum,
0.35% to 0.6% by weight nitrogen,
balance iron and unavoidable impurities.

This latter composition can be smelted and cast into forgeable ingots, bars or pellets and can be readily forged with the result that even a two-fold degree of deformation in forging results in a notch impact strength or tenacity according to the ISO-V test of more than 35 Joule with a minimum yield point of 600 $N/mm^2$.

Preferably, the composition of the steel of the present invention is:

up to 0.1% by weight carbon,
up to 1.0% by weight silicon,
4.5% to 5% by weight manganese,
25.0% to 27.5% by weight chromium,
3.5% to 5.0% by weight nickel,
1.3% to 2.5% by weight molybdenum,
0.35% to 0.45% by weight nitrogen,
balance iron and unavoidable impurities.

It has been found to be advantageous, moreover, to hold the carbon content in the range of 0.01% to 0.1% by weight and the silicon content in the range of 0.1 to 1.070, preferably the carbon content should not exceed 0.07% by weight.

For the purpose of the present invention, the manganese content can have a range between 4.5% to 6.0% by weight in an alloy having a chromium content of 24.0% to 27.5% by weight in another preferred mode of carrying out the invention in practice.

It is known that the results of a hot torsion test can be used as a measure of the critical primary deformation of forged bodies. The results of these tests are given in the following table:

TABLE

| Steel | Test temperature | No. of twists to break | Torque (Nm) |
|---|---|---|---|
| 1.4460 | 1050° C. | 10–30 | 3.9 |
| | 1150° C. | >30 | 2.7 |
| 1.4660 + | 1050° C. | 2.5–5 | 3.5 |
| 0.4% N | 1150° C. | 3–9 | 2.5 |
| Steel of | 1050° C. | 5–10 | 2.5 |
| invention | 1150° C. | >15 | 1.3 |
| (see specific example) | | | |

A significant advantage of the present invention is that temperatures about 100° C. higher than normal forging temperatures can be used in forging the steel of the present invention, thereby greatly facilitating the forging operation without detrimental effecting the forged articles.

SPECIFIC EXAMPLE

A steel containing 48% by weight austenite and of the following composition:

0.064% by weight carbon,
0.66% by weight silicon
4.66% by weight manganese,
0.019% by weight phosphorus,
0.014% by weight sulfur,
25.67% by weight chromium,
1.58% by weight molybdenum, 4.12% by weight nickel 0.38% by weight nitrogen balance iron, is cast into ingots of a weight of 2700 Kg which are remelted by the electrode slag remelting process to ESR ingots of a weight of 2.5 metric tons.

From these ingots, 200 Kg pieces are sawed off.

These pieces are forged to make 1.6 meter long turbine blades at temperatures between 1220° C. and 1050° C., each blade having a base or foot at one end and the flattened blade portion reaching toward the other. The forged blades are subjected to solution tempering for two hours at 1080° C. and are quenched in water.

The mechanical properties of a subdivided blade subjected to testing were found to be as follows:

yield point at the foot portion or base=620 N/mm$^2$ yield point at upper half=660 N/mm$^2$ notch impact strength (tenacity) in ISO-V/Charpy=90 Joule in foot portion or base notched impact strength in upper half or base=130 Joule.

200 Kg pieces of the same ingot were forged into ball-shaped bodies for separators. The different-thickness deformed zones of the body were found in similar notch impact strength tests to have values between 53 and 90 Joule at yield points between 620 and 630 N/mm$^2$.

A piece of the other ESR ingot was subjected to forging in a forging press at the above-mentioned forging temperature to a 3.6 meter long shaft with a rough outer diameter of 320 mm. The forged shaft was quenched and in spite of the limited forging (corresponding to a deformation of 2.5) was found to have yield point values of 640 N/mm$^2$ in the longitudinal direction and 630 N/mm$^2$ in the transverse direction. The notch impact strength tests of the type already described gave values of 200 Joule in the longitudinal direction and 70 Joule in the transverse direction.

All of the products were tested for intercrystalline corrosion with a usual chloride-containing calcium hydroxide solution to which silver chloride is added. Resistance to corrosion was found not only for the solution heat treated product but also for products that were annealed for periods of 20 minutes at 600° C. without showing a reduction in the corrosion resistance.

We claim:

1. A method of making corrosion resistant objects which comprises the step of forging a chromium-nickel ferritic-austenitic steel containing 30% to 70% austenite and consisting of the following composition:

up to 0.1% by weight carbon, up to 1.0% by weight silicon, 4.5% to 6.0% by weight manganese, 22.0% to 28.0% by weight chromium, 3.5% to 5.5% by weight nickel, 1.0% to 3.0% by weight molybdenum, 0.35% to 0.6% by weight nitrogen, balance iron and unavoidable impurities, to a body having a notch impact strength and tenacity in an ISO-V test of at least 35 Joule with a two degree forging and a minimum yield point of 600 N/mm$^2$.

2. The method defined in claim 1 wherein said steel consists essentially of:

0.1% by weight carbon;

up to 1.0% by weight silicon;

25.0% to 27.5% by weight chromium;

4.5 to 6.0% by weight manganese;

3.5% to 5.0% by weight nickel:

1.3% to 2.5% by weight molybdenum;

0.35% to 0.45% by weight nitrogen; and balance iron and unavoidable impurities.

3. The method defined in claim 1 wherein said steel has a carbon content of at most 0.07% by weight.

4. The method defined in claim 1 wherein said steel has a manganese content of 4.5% to 6.0% by weight.

5. The method defined in claim 1 wherein said steel has a chromium content of 24.0% to 27.5% by weight.

6. The method defined in claim 1 wherein said steel contains up to 0.045% by weight phosphorus and 0.030% by weight sulfur.

7. A forged body consisting of ferritic-austenitic chromium-nickel steel having the following composition:

up to 0.1% by weight carbon;

up to 1.0% by weight silicon;

4.5% to 6.0% by weight manganese;

22.0% to 28% by weight chromium;

3.5% to 5.5% by weight nickel;

1.0% to 3.0% by weight molybdenum;

0.35% to 0.6% by weight nitrogen; and balance iron and unavoidable impurities, with a notch impact strength of more than 35 Joule (ISO-V) with two-degree forging and a minimum yield point of 600 N/mm$^2$, the steel containing 30% to 70% austenite.

* * * * *